US009022808B2

(12) United States Patent
Yu

(10) Patent No.: US 9,022,808 B2
(45) Date of Patent: May 5, 2015

(54) CONNECTOR HAVING A CONDUCTIVE TERMINAL PROTRUDING FROM A RADIO FREQUENCY PART AND CONNECTED TO A CONDUCTIVE WIRE

(71) Applicant: Grand-Tek Technology Co., Ltd., New Taipei (TW)

(72) Inventor: Han-Hsuan Yu, New Taipei (TW)

(73) Assignee: Grand-Tek Technology Co., Ltd., New Taipei (TW)

( * ) Notice: Subject to any disclaimer, the term of this patent is extended or adjusted under 35 U.S.C. 154(b) by 0 days.

(21) Appl. No.: 14/188,740

(22) Filed: Feb. 25, 2014

(65) Prior Publication Data

US 2014/0242842 A1 Aug. 28, 2014

(30) Foreign Application Priority Data

Feb. 25, 2013 (TW) ..... 102203528 U

(51) Int. Cl.

| | |
|---|---|
| ***H01Q 1/50*** | (2006.01) |
| ***H01R 13/719*** | (2011.01) |
| ***H01R 13/66*** | (2006.01) |
| ***H01R 24/50*** | (2011.01) |
| *H01R 101/00* | (2006.01) |

(52) U.S. Cl.

CPC ..... *H01Q 1/50* (2013.01); *H01R 13/719* (2013.01); *H01R 13/665* (2013.01); *H01R 13/6658* (2013.01); *H01R 24/50* (2013.01); *H01R 2101/00* (2013.01); *H01R 2201/02* (2013.01)

(58) Field of Classification Search

CPC ... H01R 13/514; H01R 23/005; H01R 23/025
USPC ..... 439/62–75, 620.01, 620.03, 620.06
See application file for complete search history.

(56) References Cited

U.S. PATENT DOCUMENTS

| | | | | |
|---|---|---|---|---|
| 4,534,602 | A * | 8/1985 | Bley | 439/63 |
| 6,302,738 | B1 * | 10/2001 | Tonus | 439/607.23 |
| 6,884,119 | B2 * | 4/2005 | Brooks et al. | 439/620.01 |
| 7,874,845 | B1 * | 1/2011 | Tang et al. | 439/65 |
| 8,172,613 | B1 * | 5/2012 | Chen et al. | 439/582 |
| 8,747,121 | B1 * | 6/2014 | Hoffmann | 439/63 |
| 2006/0084286 | A1 * | 4/2006 | Kooiman | 439/63 |
| 2007/0148996 | A1 * | 6/2007 | Hildebrand et al. | 439/63 |
| 2010/0022103 | A1 * | 1/2010 | Murata | 439/55 |

* cited by examiner

*Primary Examiner* — Chandrika Prasad

(74) *Attorney, Agent, or Firm* — Chun-Ming Shih; HDLS IPR Services

(57) ABSTRACT

An integrated radio frequency connector installed in a main board includes a built-in radio frequency part, a connecting element and conductive wire. The connecting element is installed and electrically coupled to the built-in radio frequency part, and the connecting element has a conductive terminal protruded from the built-in radio frequency part, and an end of the conductive wire is electrically coupled to the conductive terminal, and the other end of the conductive wire is electrically coupled to the main board to achieve a modular design, so as to facilitate the assembling procedure.

10 Claims, 5 Drawing Sheets

CONNECTOR HAVING A CONDUCTIVE TERMINAL PROTRUDING FROM A RADIO FREQUENCY PART AND CONNECTED TO A CONDUCTIVE WIRE

FIELD OF THE INVENTION

The present invention relates to a connector, and more particularly to an integrated radio frequency connector.

BACKGROUND OF THE INVENTION

In general, an electronic communication product comes with a built-in radio frequency unit and an external radio frequency connector, so that the electronic product is capable of receiving or transmitting signals through the built-in radio frequency unit and electrically connecting an external radio frequency unit to the external radio frequency connector to receive or transmit the signals through the external radio frequency unit.

However, the conventional built-in radio frequency unit and the external radio frequency connector are installed on a main board of the electronic product separately, so that the built-in radio frequency unit and the external radio frequency connector must be electrically coupled to the main board through conductive wires, and thus the conductive wires increase the overall cost. In addition, it is necessary to install the built-in radio frequency unit and the external radio frequency connector onto the main board individually, and the assembling procedure becomes more complicated and difficult, and the assembling time becomes longer.

SUMMARY OF THE INVENTION

Therefore, the present invention is to provide an integrated radio frequency connector for electrically coupling a connecting element, which is pre-installed to a built-in radio frequency part, with a main board through a conductive wire to achieve a modular design to facilitate the assembling.

Accordingly, the present invention provides an integrated radio frequency connector installed on a main board and comprising a built-in radio frequency part, a connecting element and a conductive wire; a built-in radio frequency part, wherein the connecting element is installed and electrically coupled to the built-in radio frequency part, and the connecting element has a conductive terminal protruded from the built-in radio frequency part, and an end of the conductive wire is electrically coupled to the conductive terminal, and the other end of the conductive wire is electrically coupled to the main board.

The present invention further has the following effects:

1. The built-in radio frequency part and the connecting element are electrically coupled to the main board simply by a conductive wire, so that the material cost of the conductive wire can be saved.

2. The modular design of installing the connecting element to the built-in radio frequency part provides a quick assembling method.

3. The grounding element is electrically coupled to the built-in radio frequency part and the main board to improve the effects of receiving and transmitting data signals by the built-in radio frequency part.

4. The fixing pin of the connecting element is passed and fixed into the fixing hole of the built-in radio frequency part to secure the connecting element and fix with the built-in radio frequency part to achieve the effect of preventing the connecting element from falling apart from the built-in radio frequency part.

DESCRIPTION OF THE PREFERRED EMBODIMENTS

The technical contents of the present invention will become apparent with the detailed description of preferred embodiments accompanied with the illustration of related drawings as follows. It is intended that the embodiments and figures disclosed herein are to be considered illustrative rather than restrictive.

Figure 1:
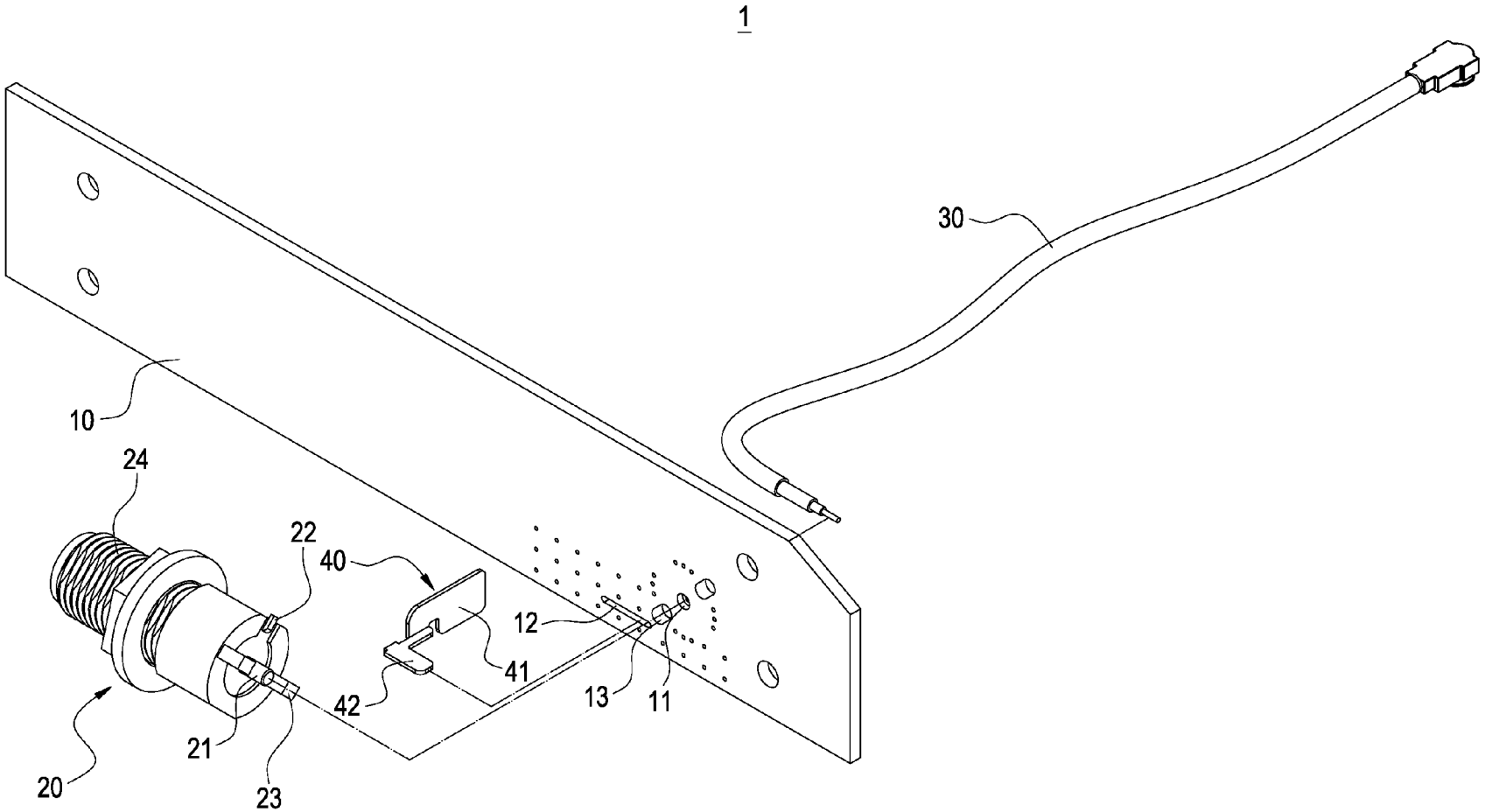
FIG. 1 is an exploded view of the present invention.
Figure 2:
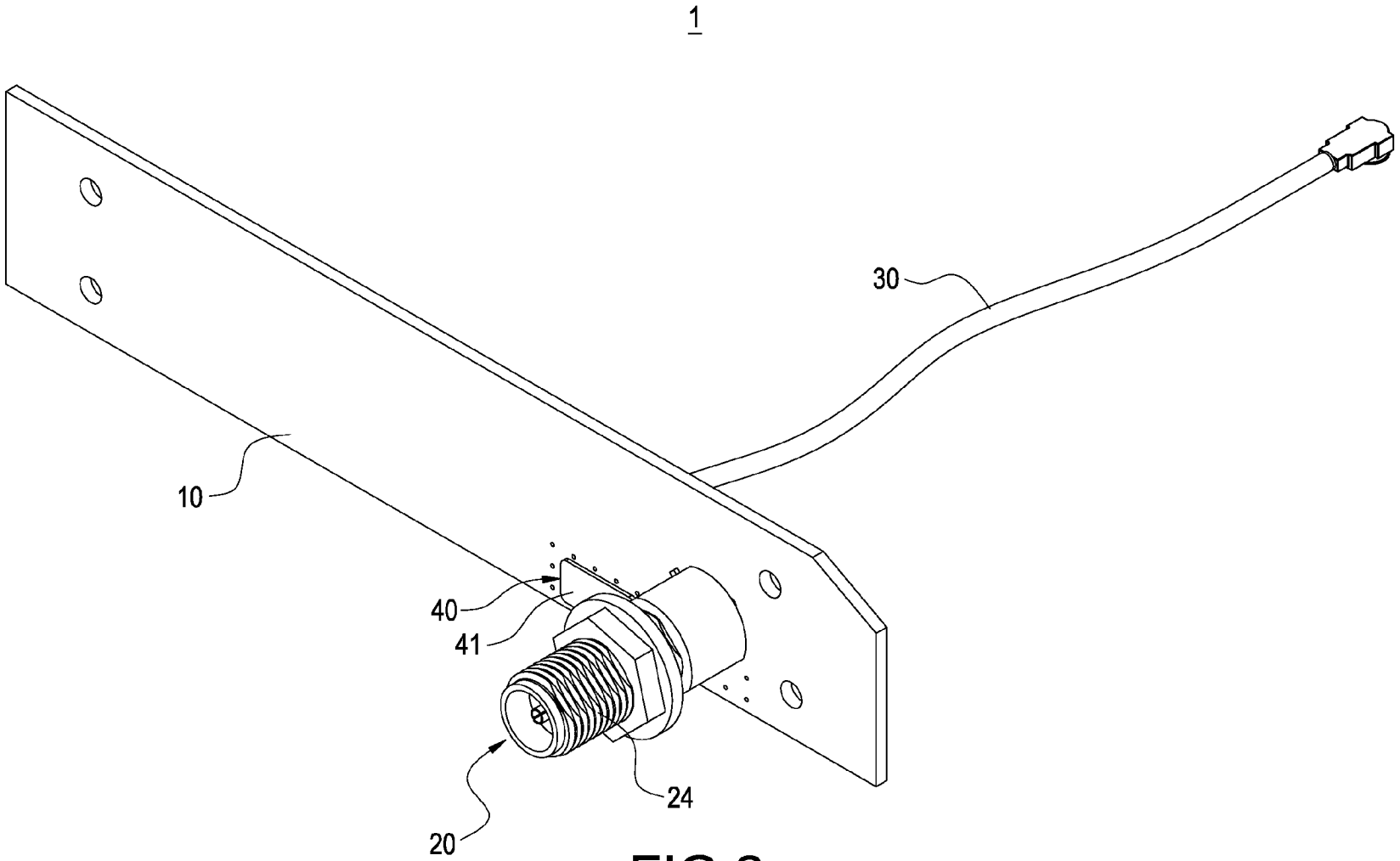
FIG. 2 is a perspective view of the present invention.
Figure 3:
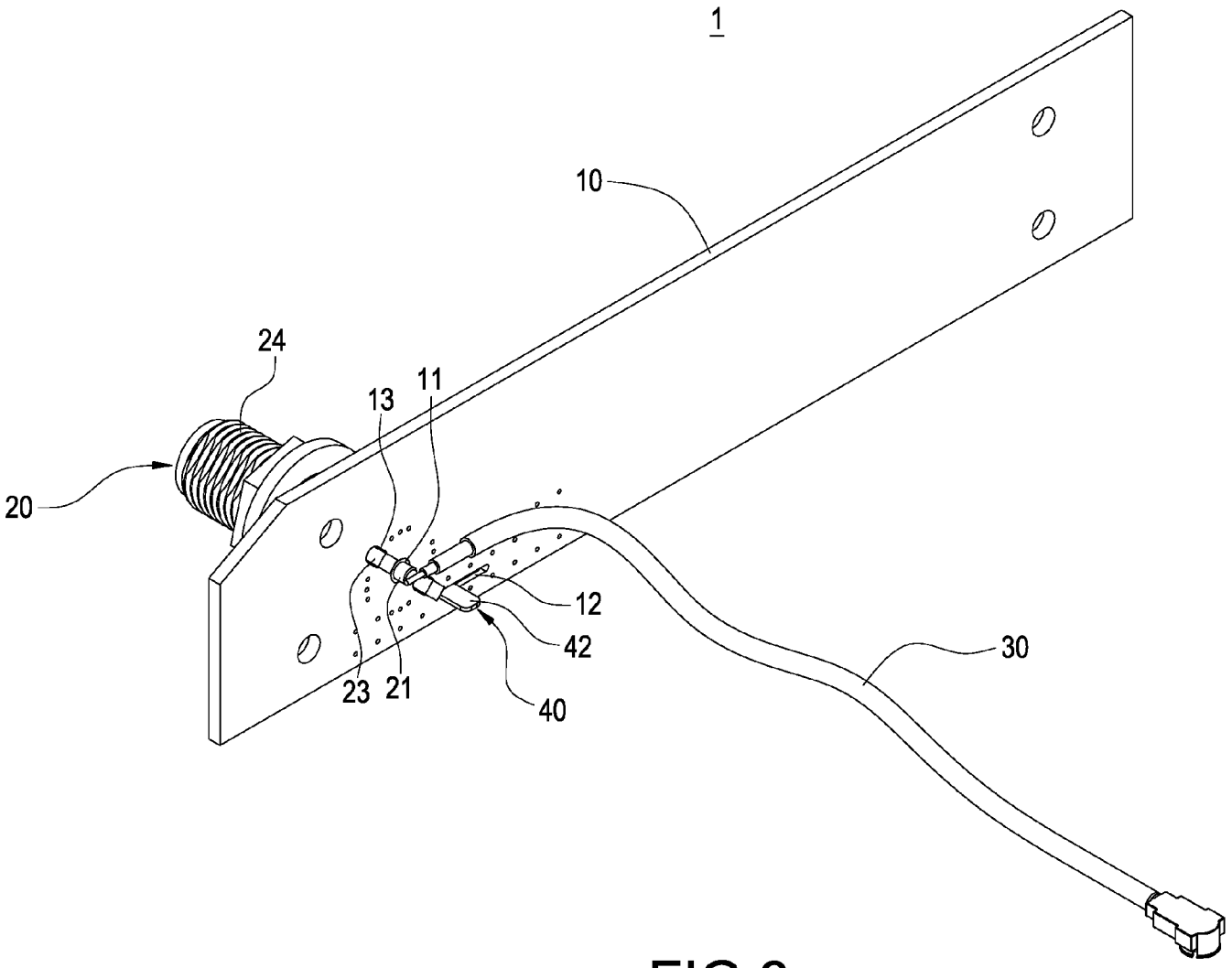
FIG. 3 is a schematic view of the present invention.

With reference to FIGS. 1 to 3 for an exploded view, a perspective view and a schematic view of the present invention, respectively, the present invention provides an integrated radio frequency connector 1 installed to a main board 9 (shown in FIG. 4 or 5) and comprising a built-in radio frequency part 10, a connecting element 20 and a conductive wire 30.

The built-in radio frequency part 10 has a through hole 11, a penetrating hole 12 and a fixing hole 13, and further includes a circuit board and a radio frequency circuit formed on a circuit board.

Figure 5:
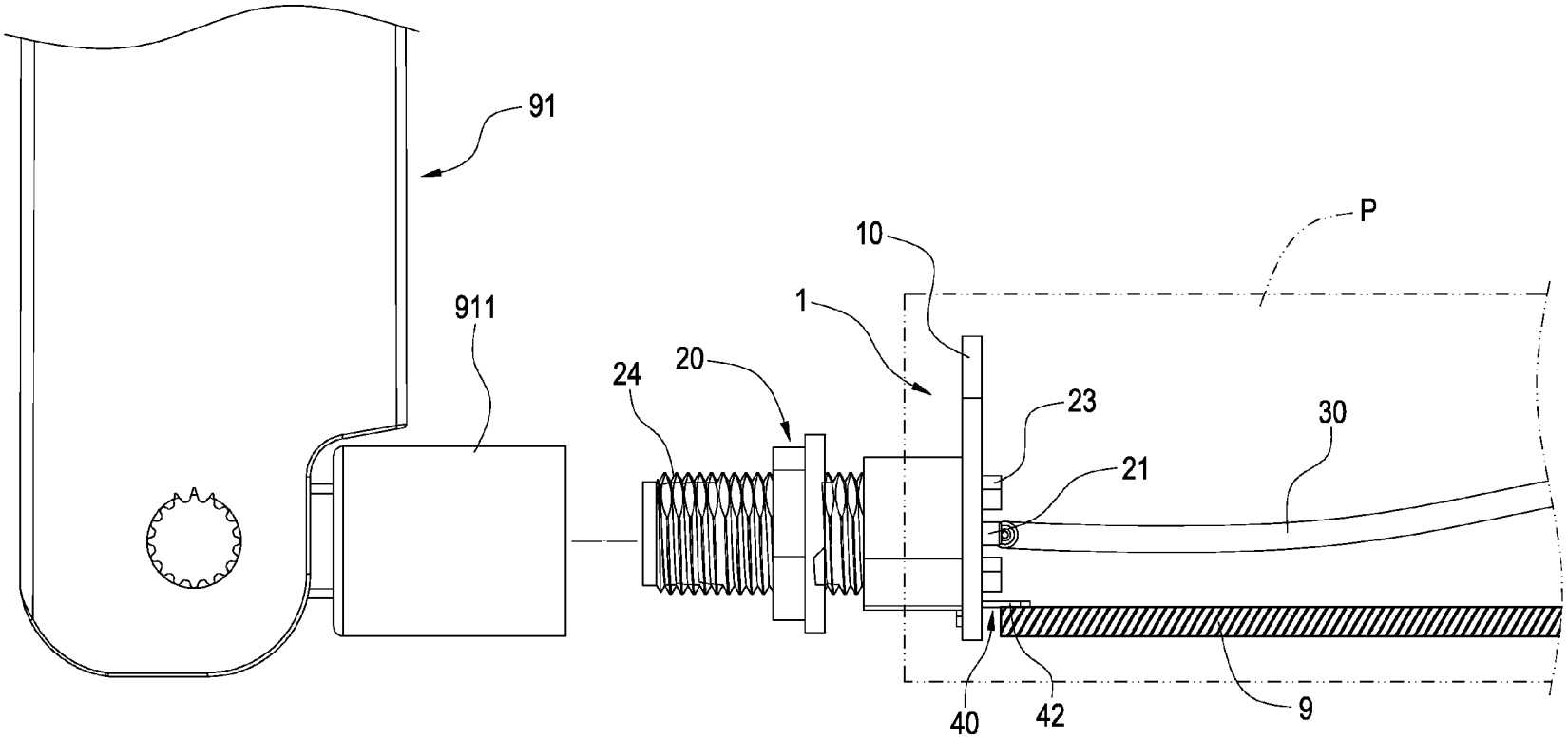
FIG. 5 is a schematic view of a second using status according to the present invention.

The connecting element 20 is a coaxial connector installed and electrically coupled to the built-in radio frequency part 10, and the connecting element 20 has a conductive terminal 21, a conductive portion 22 and at least one fixing pin 23 disposed at an end proximate to the built-in radio frequency part 10 and a female connector 24 disposed on a side of the connecting element 20 away from the built-in radio frequency part 10, and the female connector 24 is provided for plugging an external radio frequency part 91, and the external radio frequency part 91 is an external antenna (see FIG. 5).

The conductive terminal 21 is passed and coupled to the through hole 11 of the built-in radio frequency part 10, and an end of the conductive terminal 21 is protruded and exposed from the built-in radio frequency part 10.

A side of the conductive portion 22 away from the connecting element 20 is attached onto a side of the built-in radio frequency part 10 proximate to the connecting element 20, and the conductive portion 22 is electrically coupled to the built-in radio frequency part 10, so that the connecting element 20 can be electrically coupled to the built-in radio frequency part 10 through the conductive portion 22.

The fixing pin 23 is passed and fixed into the fixing hole 13 of the built-in radio frequency part 10 to secure the connecting element 20 and fix with the built-in radio frequency part 10.

An end of the conductive wire 30 is electrically coupled to the conductive terminal 21 and exposed from an end of the built-in radio frequency part 10, and the other end of the conductive wire 30 is electrically coupled to the main board 9.

The integrated radio frequency connector 1 further comprises a grounding element 40 having a positioning plate 41 and a grounding terminal 42, and the grounding terminal 42 is extended, bent and formed from the positioning plate 41. The positioning plate 41 is attached and electrically coupled to a side of the built-in radio frequency part 10 proximate to the connecting element 20. The grounding terminal 42 is passed and coupled into the penetrating hole 12 of the built-in radio frequency part 10, and an end of the grounding terminal 42 away from the connecting element 20 is electrically coupled to the main board 9.

Figure 4:
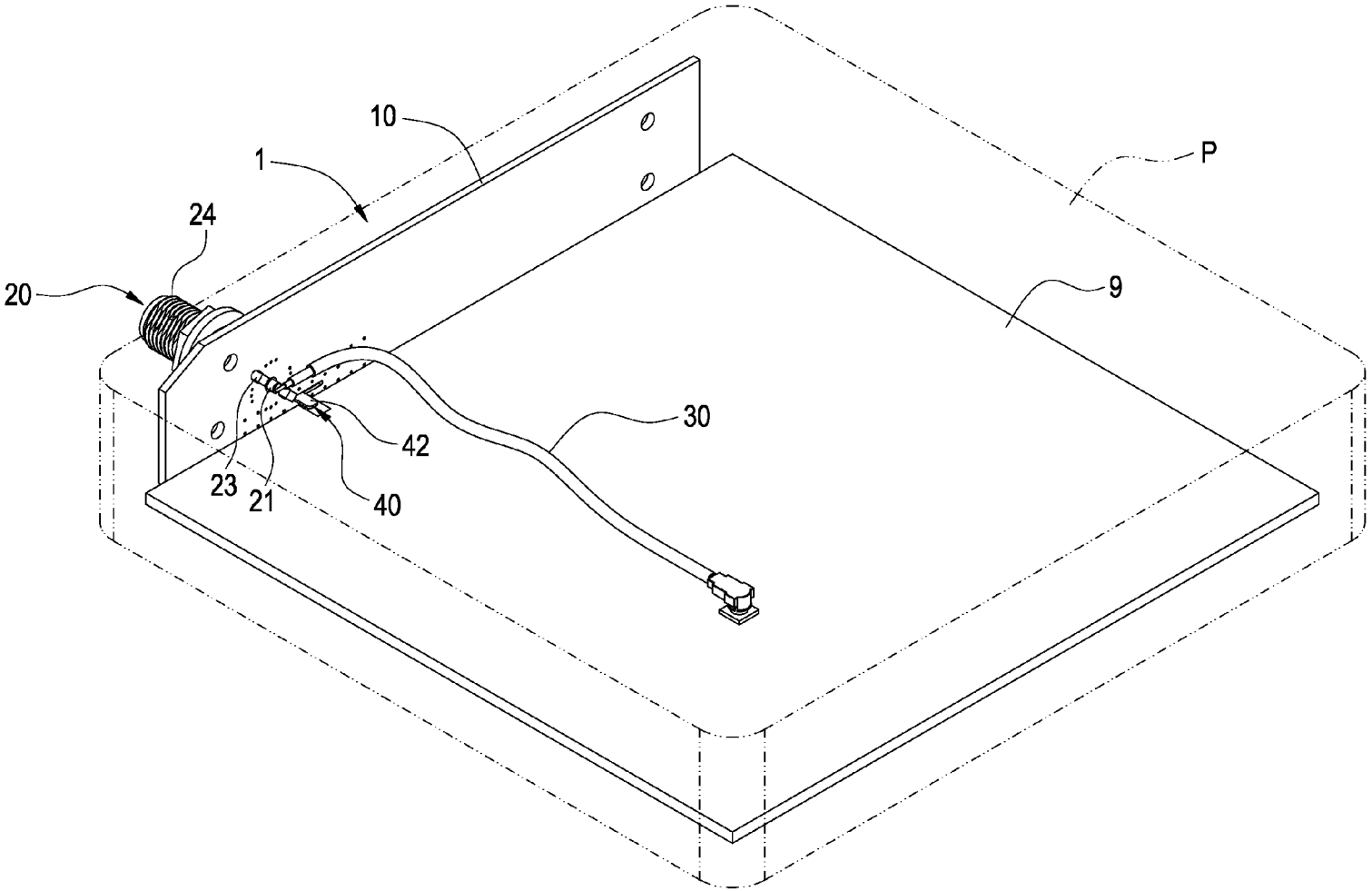
FIG. 4 is a schematic view of a first using status according to the present invention.

With reference to FIGS. 4 and 5 for the first and second using statuses of the present invention, respectively, during use, a male connector 911 of the external radio frequency part 91 is not electrically coupled to a female connector 24 of the connecting element 20. After an external data signal of an electronic product P is received by the built-in radio frequency part 10, the data signal is transmitted from the conductive portion 22 to the connecting element 20, and then transmitted from the conductive terminal 21 of the connecting element 20 to the conductive wire 30, and finally transmitted to the main board 9 through the conductive wire 30. An internal data signal of the electronic product P also can be transmitted through the main board 9, the conductive wire 30, the conductive terminal 21, the connecting element 20 and the conductive portion 22 to the built-in radio frequency part 10, and then transmitted from the built-in radio frequency part 10 to the outside of the electronic product P.

When the male connector 911 of the external radio frequency part 91 is electrically coupled to the female connector 24 of the connecting element 20, an open circuit occurs between the connecting element 20 and the built-in radio frequency part 10, so that the external data signal of the electronic product P can be received through the external radio frequency part 91 and transmitted from the external radio frequency part 91 to the connecting element 20, and then transmitted to the conductive wire 30 through the conductive terminal 21 of the connecting element 20, and finally transmitted from the conductive wire 30 to the main board 9. The internal data signal of the electronic product P also can be transmitted sequentially through the conductive wire 30, the conductive terminal 21 and the connecting element 20 *t* the external radio frequency part 91 and finally transmitted from the external radio frequency part 91 to the outside of the electronic product P.

The connecting element 20 is installed to the built-in radio frequency part 10, so that the connecting element 20 and the built-in radio frequency part 10 are integrated as a whole, and finally the conductive wire 30 is electrically coupled to the conductive terminal 21 and the main board 9 to achieve the effect of a modular design, and the integrated radio frequency connector 1 can have a quick and convenient assembling procedure and achieve the effect of saving space as well as reducing the volume of the electronic product P, so as to further reduce the space occupied by the electronic product P. In addition, the cost for the conductive wire 30 can be reduced to lower the total cost.

Since the grounding element 40 is electrically coupled to the built-in radio frequency part 10 and the main board 9, therefore noises such as electromagnetic waves or static charges produced during the operation of other electronic components in the electronic product P can be guided by the grounding element 40 quickly into the built-in radio frequency part 10 to prevent the data signal received by the built-in radio frequency part 10 from being interfered by the noises such as the electromagnetic waves or static charges, so as to further improve the effects of transmitting and receiving the data signal through the built-in radio frequency part 10.

In addition, the fixing pin 23 of the connecting element 20 is passed and fixed into the fixing hole 13 of the built-in radio frequency part 10 to secure the connecting element 20 and fix with the built-in radio frequency part 10, so as to achieve the effect of preventing the connecting element 20 from falling apart from the built-in radio frequency part 10.

The present invention achieves the expected objectives and overcomes the drawbacks of the prior art, and the invention complies with patent application requirements, and is thus duly filed for patent application.

While the invention has been described by means of specific embodiments, numerous modifications and variations could be made thereto by those skilled in the art without departing from the scope and spirit of the invention set forth in the claims.

What is claimed is:

1. An integrated radio frequency connector 1, installed to a main board 9, comprising:

a built-in radio frequency part 10;

a connecting element 20, installed and electrically coupled to the built-in radio frequency part 10, and having a conductive terminal 21 protruded out from the built-in radio frequency part 10; and a conductive wire 30, with an end electrically coupled to the conductive terminal 21, and the other end electrically coupled to the main board 9.

2. The integrated radio frequency connector of claim 1, wherein the conductive terminal 21 is disposed at an end of the connecting element 20 proximate to the built-in radio frequency part 10.

3. The integrated radio frequency connector of claim 2, wherein the built-in radio frequency part 10 has a through hole 11, and the conductive terminal 21 is passed through and coupled to the through hole 11, and an end of the conductive terminal 21 is protruded and exposed from the built-in radio frequency part 10.

4. The integrated radio frequency connector of claim 1, wherein the connecting element 20 has a conductive portion 22 disposed at an end proximate to the built-in radio frequency part 10, and the connecting element 20 is electrically coupled to the built-in radio frequency part 10 through the conductive portion 22.

5. The integrated radio frequency connector of claim 4, wherein the conductive portion 22 is attached and electrically coupled to a side of the built-in radio frequency part 10 proximate to the connecting element 20.

6. The integrated radio frequency connector of claim 1, further comprising a grounding element 40 with an end of the grounding element 40 electrically coupled to the built-in radio frequency part 10 and the other end electrically coupled to the main board 9.

7. The integrated radio frequency connector of claim 6, wherein the grounding element 40 includes a positioning plate 41 and a grounding terminal 42 extended, bent and formed from the positioning plate 41, and the positioning plate 41 is attached and electrically coupled to a side of the built-in radio frequency part 10 proximate to the connecting element 20, and the grounding terminal 42 is passed through and coupled to the built-in radio frequency part 10 and electrically coupled to the main board 9.

8. The integrated radio frequency connector of claim 7, wherein the built-in radio frequency part 10 has a penetrating hole 12, and the grounding terminal 42 is passed through and coupled to the penetrating hole 12, and an end of the grounding terminal 42 away from the connecting element 20 is electrically coupled to the main board 9.

9. The integrated radio frequency connector of claim 1, wherein the connecting element 20 has at least one fixing pin 23 disposed at an end proximate to the built-in radio frequency part 10, and the fixing pin 23 is passed through and fixed to the built-in radio frequency part 10.

10. The integrated radio frequency connector of claim 9, wherein the built-in radio frequency part 10 has a fixing hole 13 for passing and fixing the fixing pin 23 therein.

* * * * *